United States Patent [19]

Naito

[11] Patent Number: 4,977,804

[45] Date of Patent: Dec. 18, 1990

[54] PUNCH PRESS

[75] Inventor: Kinshiro Naito, Isehara, Japan

[73] Assignee: Amada Company, Limited, Japan

[21] Appl. No.: 305,758

[22] Filed: Feb. 3, 1989

[30] Foreign Application Priority Data

Feb. 5, 1988 [JP] Japan ..... 63-13627[U]
Feb. 5, 1988 [JP] Japan ..... 63-13628[U]

[51] Int. Cl.[5] ..... B21B 28/34; B21B 45/04

[52] U.S. Cl. ..... 83/76.7; 83/98; 83/129; 83/169; 83/684

[58] Field of Search ..... 83/99, 98, 169, 72, 83/549, 550, 551, 552, 684, 685, 686, 687, 688, 689, 129, 700, 170, 100, 76.7

[56] References Cited

U.S. PATENT DOCUMENTS

| | | | |
|---|---|---|---|
| 2,251,135 | 7/1941 | Iknayan et al. | 83/98 X |
| 2,313,525 | 3/1943 | Edelman | 83/98 |
| 3,550,491 | 12/1970 | Wingard | 83/99 X |
| 3,771,396 | 11/1973 | Imi | 83/98 |
| 4,628,780 | 12/1986 | Hicks | 83/99 |
| 4,771,663 | 9/1988 | Naito et al. | 83/689 X |

FOREIGN PATENT DOCUMENTS

| | | | |
|---|---|---|---|
| 2637085 | 2/1978 | Fed. Rep. of Germany | 83/99 |

*Primary Examiner*—Frank T. Yost
*Assistant Examiner*—Rinaldi Rada
*Attorney, Agent, or Firm*—Wigman & Cohen

[57] ABSTRACT

A punch press having a die formed with a diehole and mounted on a die holder and a punch set provided with a punch mounted on a punch holder for performing a punching process on a workpiece in cooperation with the die. The punch set is formed with a fluid discharge orifice for discharging a fluid into the diehole, and the punch is formed with a communication orifice communicating with the fluid discharge orifice. A ram for striking the punch is formed with a fluid supply orifice for freely communicating with the communicating orifice. A connecting pipe connects the fluid supply orifice with a fluid source; a shut-off valve is provided for opening or shutting of the connecting pipe, with a stroke position detector for detecting the stroke of the ram. A shut-off valve control is provided for controlling the opening or shutting of the shut-off valve according to the values detected by the stroke position detector.

8 Claims, 3 Drawing Sheets

PUNCH PRESS

BACKGROUND OF THE INVENTION

1. Field of the Invention

The present invention relates to a punch press, and, in particular, to a punch press wherein it is possible to reliably cause a blank or a scrap punched from a workpiece to drop from the die hole of the die, and wherein the sliding section of the punch set can be automatically lubricated.

2. Description of the Prior Art

Conventionally, when a punching process utilizing a punch set and a die mounted on a punch press is performed, a blank or scrap punched from the workpiece once in a while does not drop down from the die hole of the die, but follows the elevation of the punch and rises on the upper surface of the die. In such a case, when the next punching process occurs, it can happen that the punching process is performed to the workpieces on which the scrap is piled up, presenting the possibility of damage to the punch set and die.

Accordingly, the technology has been developed wherein, when the punching process takes place, in order to cause the scrap and the like to reliably fall from the die hole, a fluid jet orifice is provided in the punch set on the centerline of the shaft of the punch, and a fluid feed orifice for freely communicating with the fluid jet orifice is provided on a ram which strikes the punch. When the ram reaches the vicinity of its lowest point compressed fluid is expelled from the fluid jet orifice of the punch and the scrap and the like is caused to drop from the die hole (For example, in Japanese Utility Model Publication No. Sho-55-5887).

However, in conventional configurations, a connecting orifice connecting to a pressure source is provided in a ram guide section for guiding the vertical action of the ram so that when the ram reaches the vicinity of its lowest point the connecting orifice communicates with the fluid feed orifice provided in the ram. Specifically, the timing of the feeding of the compressed fluid to the fluid jet orifice of the punch through the fluid feed orifice of the ram is unadjustable.

Accordingly, in the case where the height of the punch differs for each punch set, for example, and in the case where the punch becomes slightly shortened as a result of wear and repolishing, there is no compensation for the volume of the compressed fluid corresponding to the shortened portion, even though this is necessary; i.e. because the feed timing of the compressed fluid is constant, the compressed fluid becomes inadequate, and the dropping of the scrap and the like from the die becomes unreliable, leading to problems.

In addition, in the case, for example, where the workpiece is punched consecutively by a punch with a square cross section and a slot is formed, i.e. a nibbling process is carried out on the workpiece, the width of the punched hole part is minutely reduced when next punching process is carried out; therefore, a string-shaped residue is adhering to the peripheral surface of the punch. This residue may drop onto the top surface of the workpiece, and when the workpiece is punched, the problem arises that applying pressure by means of the punch guide or a stripper produces damage on the top surface of the workpiece.

Further, in a conventional punch set, when the sliding sections between the punch and the punch guide, and between the punch guide and the punch holder and the like, are lubricated prior to using the punch. However, there are occasions when lubricant is not used. Accordingly, there are cases where the lubrication of the sliding parts of the punch guide is inadequate.

SUMMARY OF THE INVENTION

A first object of the present invention is to provide with due consideration to the drawbacks of such conventional devices, a punch press wherein the emission of the compressed fluid from the fluid jet orifice occurs at the desired timing.

A second object of the present invention is to provide a punch press wherein, even in the case where a string-shaped residue adheres to the peripheral surface of the punch when the nibbling process is carried out, that residue can be reliably caused to fall from the die.

A third object of the present invention is to provide a punch press wherein the sliding parts of the punch set are automatically lubricated and the amount of lubricant used can be controlled.

The punch press according to the present invention, to meet the above-mentioned objects, comprises a die formed with a diehole and mounted on a die holder; a punch set provided with a punch mounted on a punch holder for performing a punching process on a workpiece in cooperation with the die, the punch set being formed with a fluid discharge orifice means for discharging a fluid into the diehole, and the punch being formed with a communication orifice communicating with the fluid discharge orifice; a ram for striking the punch, formed with a fluid supply orifice for freely communicating with the communicating orifice; a connecting pipe means for connecting the fluid supply orifice with a fluid source; a shut-off valve means for opening or shutting of the connecting pipe; a stroke position detection means for detecting the stroke of the ram; and a shut-off valve control means for controlling the opening on shutting of the shut-off valve according to the values detected by the stroke position detection device.

BRIEF DESCRIPTION OF THE DRAWINGS

These and other objects, features, and advantages of the present invention will become more apparent from the following description of the preferred embodiments taken in conjunction with the accompanying drawings, in which.

DETAILED DESCRIPTION OF THE PREFERRED EMBODIMENTS

Figure 1:
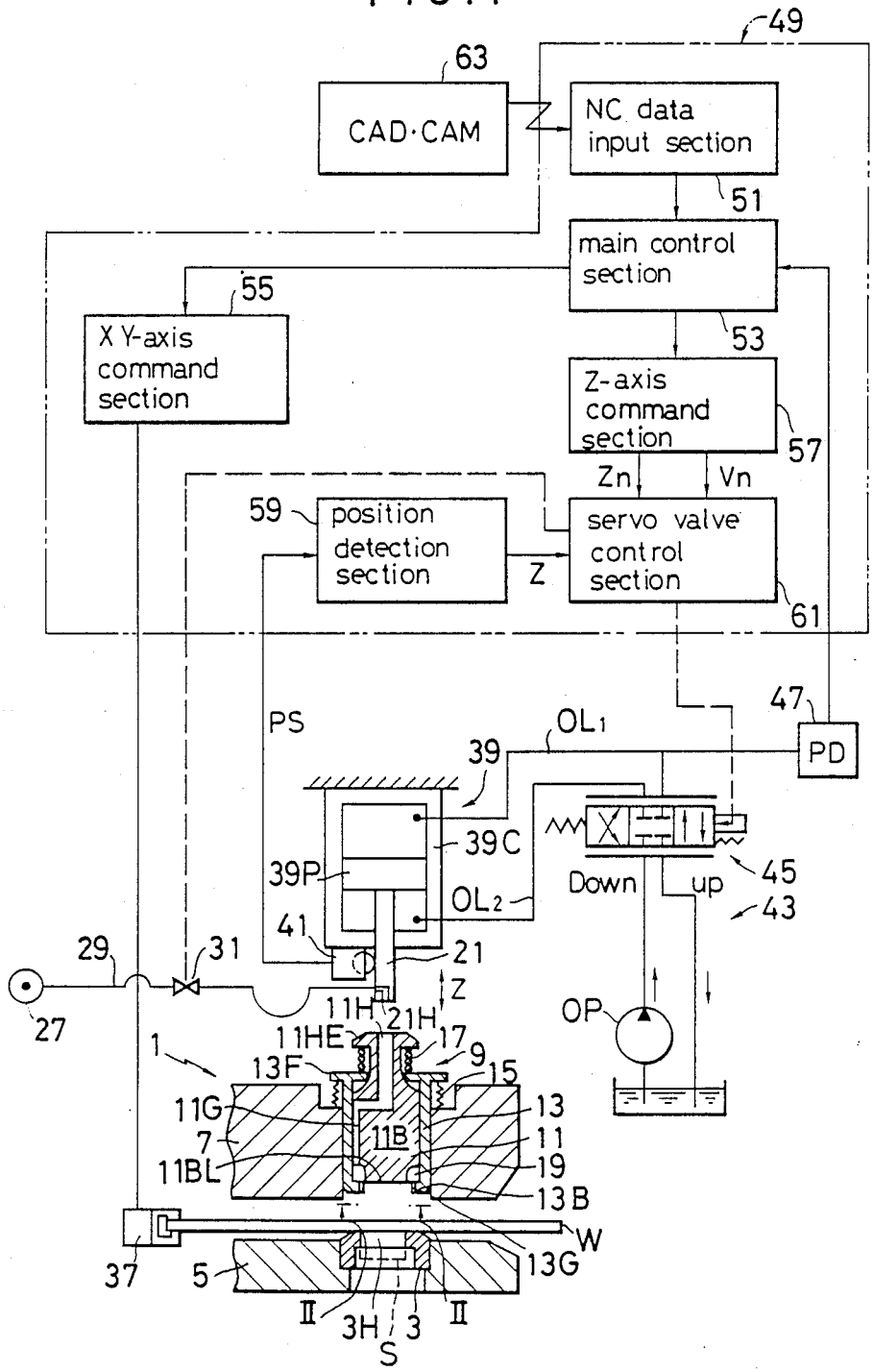
FIG. 1 is an explanatory drawing showing an embodiment of the punch press of the present invention, wherein the main parts are shown in cross section.

Now referring to FIG. 1, a turret punch press 1 is shown as an example of an embodiment of the punch press of the present invention.

As is commonly known, the turret punch press 1 is provided with a lower turret 5 as a die holder on which a die 3 is maintained. An upper turret 7 is provided as a punch holder, in correspondence with the lower turret 5. A punch set 9 is supported on the upper turret 7. A punch 11 which performs a punching process on a workpiece W in cooperation with the die 3 is supported on the punch set 9 in a manner to provide freely vertical movement.

To explain in more detail, the punch set 9 is provided with a tubular punch guide 13 which is supported on the upper turret 7 in a manner to allow free vertical movement of the punch guide 13. The punch 11 is so provided as to be movable in a vertical direction inside the punch guide 13.

Figure 2:
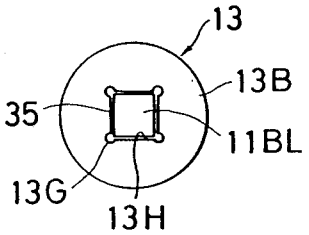
FIG. 2 is a sectional drawing of FIG. 1 viewed in the direction of the arrows of the line II—II.

A flange section 13F is provided on the upper section of the punch guide 13. A lifter spring 15 which lifts the entire punch set 9 is mounted between the flange section 13F and the upper turret 7. A punch blade 11BL is provided on the lower end of a punch body 11B on the punch 11. An orifice 13H is formed in a bottom section 13B of the punch guide 13, as shown in FIG. 2; the cross-sectional shape of the orifice 13H corresponds with that of the punch blade 11BL. A groove 13G of a suitable shape is formed in a plurality of locations in the orifice 13H.

A punch head 11HE is suitably provided on the upper end of the punch body 11B of the punch 11. A stripper spring 17 which is stronger than the lifter spring 15 is mounted between the punch head 11HE and the punch guide 13. In addition, a communication orifice 11H is provided in the punch body 11B, opening at the upper end of the punch body 11B. The lower section of the communication orifice 11H communicates with an open area 19 situated between the bottom section 13B of the punch guide 13 and the punch body 11B.

Further, in this embodiment of the present invention, the communication orifice 11H communicates with a groove 11G formed in the vertical direction in the peripheral surface of the punch body 11B, and is connected to the open area 19 through the groove 11G.

On the turret press 1, a ram 21 is provided in a manner to allow free vertical movement to strike the punch head 11HE of the punch 11 on the punch set 9. The ram 21 is moved in the vertical direction by the vertical movement of a ram cylinder piston 39P provided in a vertically movable manner.

In FIG. 1, the workpiece W is clamped by a clamp device 37 on a positioning device so that it is capable of movement in the X-axis and Y-axis directions.

A cylinder device 39 having the ram 21 is provided on the upper part of the punch set 9 for moving the ram 21 in the vertical direction. A piston 39P is provided inside a cylinder 39C of the cylinder device 39. The ram 21 which freely moves in the vertical (Z-axis) direction is an integral part of the piston 39P.

A fluid feed orifice 21H, which can freely communicate with the communication orifice 11H in the punch 11 when the punch 11 is striked, is provided on the ram 21. The fluid feed orifice 21H is connected to a pressure source 27 which supplies a fluid such as, for example, oil mist or the like through a connecting pipe 29. Although, detailed explanations are omitted, at any vertical position of the ram 21, the fluid feed orifice 21H is connected to the pressure source 27 through the connecting pipe 29, which is contrast to the prior art disclosed in Japanese Utility Model Publication application No. SHO-55-55887, wherein a fluid feed orifice formed on a ram is connected to a pressure source only when the ram is descended at a specified vertical position, as is explained before. A shut-off valve 31 is installed in the feed pipe 29.

The shut-off valve 31 is provided to open or block off the connecting pipe 29. This opening or blocking action is performed under the control of a servo valve control section 33, which is described in detail hereinafter.

On the bottom surface of the cylinder 39C, a position detection device 41, such as pulse encoder is provided, in which a roller is caused to contact a side surface of the ram 21 and the vertical movement of the ram is detected from pulse signal PS.

A hydraulic circuit 43 for controlling the action of the cylinder device 39 is provided with a hydraulic pump OP and a servo valve 45 which is connected to an upper and a lower chamber of the cylinder 39C throuth a pipe OL1 and a pipe OL2. A pressure detection apparatus 47 which detects the pressure inside the pipe from an electrical signal is provided on the pipe OL1.

An NC device 49 for controlling the abovementioned positioning device and the servo valve 45 comprises an NC data input section 51, a main control section 53, an XY-axes command section 55, a Z-axis command section 57, a position detection section 59, and a servo valve control section 61.

The NC data input section 51 is communicatingly connected either on-line or off-line with, for example, a CAD/CAM device 63, and provides NC data for control of the turret punch press.

The main control section 53 mainly controls the position of the workpiece W and the driving of the cylinder device 39 according to the NC data from the NC data input section 51. Also, a main control section 53 is connected to a variety of sensors, limit switches, and various other types of actuators for over-all control of the turret punch press 1.

The XY-axes command section 55 receives specific positional control data from the main control section 53, and by driving X-axis and Y-axis servo motors, controls the positioning of the workpiece W in the XY plane.

The Z-axis command section 57 receives Z-axis command data from the main control section 53 and outputs data for a position Zn and a velocity Vn to drive the servo valve 45.

The position detection section 59 integrates the pulse signal PS output from the position detection device 41 and detects the current position Z of the ram 21. The position detection device 41 is a device which outputs a pulse signal of two phases which differ by $\frac{1}{4}$, so that the direction of movement of the ram 21 can be detected on the basis of these two pulse signals.

The servo valve control section 61 receives the positional data Zn and the velocity data Vn from the Z-axis command section 57 and the current position Z of the ram 21 from the position detection section 59 as input, and, based on these inputs, controls position or degree of opening of the servo valve 45. In this way, by controlling the ram 21, the stroke of the punch 11 in the punch set 9 can be controlled.

In the above mentioned configulation, when the oil airunit 43 is activated, the ram 21 of the cylinder 39 starts to descend to contact the punch head 11HE of the punch 11, and bottom section 11BL of the punch 11 contacts the upper surface of the workpiece W. When the bottom section 11BL of the punch 11 contacts the upper surface of the workpiece W, the pressure within the cylinder chamber 39C is abruptly increased. This pressure increase is detected by the pressure sensor 47. On the other hand, the ram stroke position at that moment is detected by the encoder 41 and the position detection sensor 59. Thus, by comparing the pressure data and the position data, the position of the top surface of the workpiece, therefore the thickness of the workpiece, can be determined. Here, instead of determining the thickness of the workpiece by performing punch process, the height of punch set 9, distance between the lower end of the punch 11 and the top surface of the workpiece W and workpiece thickness, which were measured in advance, can be input in the NC device 49 through NC data input section 51.

In the case where second punching strike is applied to the same workpiece, the ram 21 again starts to descend from the uppermost point. The vertical position of the ram is detected by means of the position detection apparatus (e.g. encorder) 41 provided on the cylinder 39.

When the ram 21 descends to contact the punch head 11HE of the punch 11, first, the lifter spring 15 is compressed, the entire punch set 9 descends, the bottom section 13B of the punch guide 13 contacts the upper surface of the workpiece W, and the workpiece W is secured to the die 3 by the pressure. The bottom section 13B of the punch guide 13 contacts the workpiece W, and when the descent of the punch guide 13 is halted, the stripper spring 17 is then compressed and the punch 11 descends even further. The punch blade 11BL of the punch 11 then performs the punching process on the workpiece W by means of a die hole 3H in the die 3.

When the ram 21 come to a predetermined height position, which is slightly higher (e.g. by 2 mm) than the position where the bottom section of the punch 11 first contacts the top surface of the workpiece (the latter position has been detected by the first punching stroke operation is described before), the position detecting device 41 and position detection section 59 detect the occurence of the ram 21 coming to the predetermined height position to open the shut-off valve 31 by means of the control of servo valve control section 61.

When the ram 21 contacts the punch head 11HE of the punch 11, the fluid feed orifice 21H provided on the ram 21 and the communication orifice 11H provided on the punch 11 are comunicatingly linked.

Accordingly, the fluid such as the oil mist or the like from the pressure pump 27 passes through the fluid feed orifice 21H and supplies the communication orifice 11H of the punch 11. This fluid is emitted in the downward direction from a clearance 35 (in FIG. 2) between the punch blade 11BL of the punch 11 and the orifice 13H of the punch guide 13, and from the groove 13G of the punch guide 13, through the groove 11G and the open area 19. For this reason, the blank or scrap S punched from the workpiece W is reliably caused to fall from the die hole H of the die 3.

In the above manner, when the fluid, such as the oil mist or the like, is emitted in the downward direction from the punch set 9, because the fluid is circulated through part of the groove 11G of the punch 11, a part of the fluid flows between the punch body 11B and the punch guide 13, thereby the sliding parts thereof being lubricated.

When the punch 11 returns to its upper most point after completion of punching, the shut-valve 31 is closed by the detection of the fact that the ram 21 passes by the predetermined position slightly higher than the punch-workpiece contact position.

Because the shut-off valve 31 is opened and closed under the control of the shut-off valve control device 33 based on the ram stroke position when the bottom section of the punch first contact the top surface of the workpiece and because this ram stroke position is detected for each workpiece by first trial punching stroke operation, even if there are occasions where the height of the punch 11 in the punch set 9 varies, the shut-off valve 31 can be controlled to open at the desired position during the descent of the punch 11. Thus, the scrap S can be caused to fall from the die hole 3H in the die 3 in a reliable manner.

In addition, because the period of closure of the shut-off valve 31 can be controlled by the servo valve control section 61, it becomes possible to have a certain degree of control over the amount of fluid flowing between the punch body 11B and the punch guide 13. Also because of capable of controlling the amount of oil mist or the like. There is no contamination of the surrounding environment by a fluid such as oil mist or the like.

In addition, as previously discussed, because the fluid is emitted from the groove 13G on the bottom of the punch guide 13 and from the clearance 35 between the punch blade 11BL and the orifice 13H of the punch guide 13, in the following process, even if string-shaped residue is adhering to the vicinity of the peripheral surface of the punch blade 11BL, that residue is flushed in the downward direction by the fluid. Accordingly, the residue does not fall onto the top surface of the workpiece W, which is therefore protected from damage by the residue.

Further, as previously discussed, the fluid is supplied each time the workpiece W is punched and the sliding parts of the punch set are lubricated. Therefore there is no lack of lubrication and the life of the punch set is prolonged.

Figure 3:
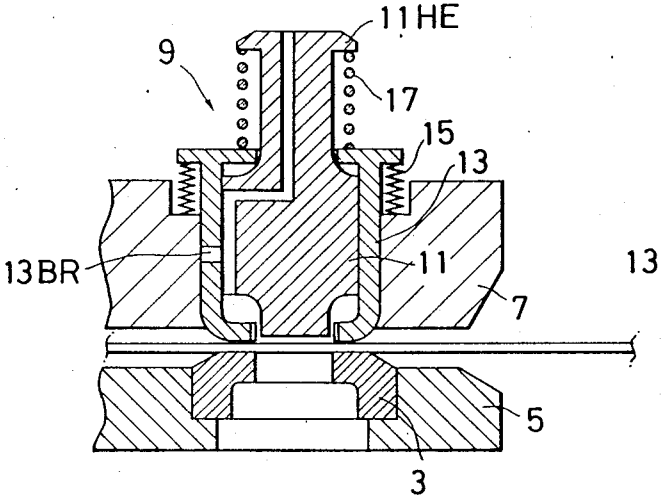

FIG. 3 shows a second embodiment of the present invention. This second embodiment differs from the first embodiment shown in FIG. 1 and FIG. 2 inasmuch as a through-hole 13BR is provided in the body of the punch guide 13 communicating with the groove 11G in the punch 11. In this embodiment of the present invention the fluid flows through the through-hole 13BR between the punch guide 13 and the punch holder 7 and lubricates the sliding surfaces between the punch guide 13 and the punch holder 7. Accordingly, the punch set 9 receives better lubrication and its life is extended.

Figure 4:
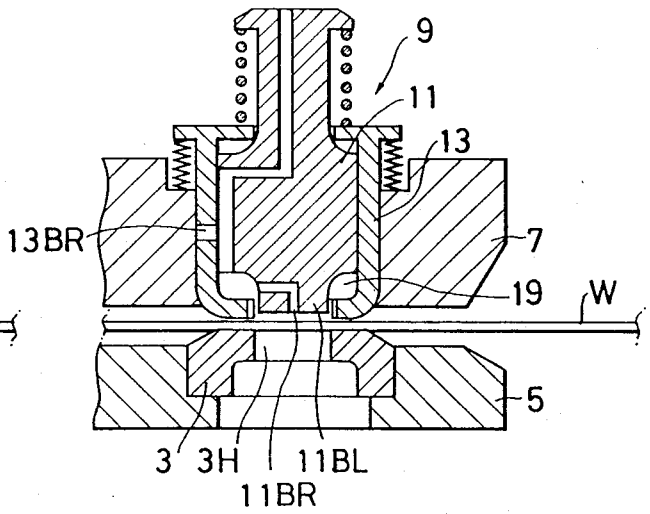
FIG. 3 and FIG. 4 are cross sectional drawings showing a second and a third embodiment respectively of the present invention.

FIG. 4 shows an embodiment of the present invention featuring further improvements. A through-hole 11BR is provided in the center section of the punch blade 11BL in the punch 11 and communicates with the open area 19. In this configuration, even in the case where the clearance between the punch blade 11BL and the die hole 3H of the die 3 is small in order to carry out a high precision punching process and a large quantity of fluid can not be fed to the inside of die hole 3H from the periphery of the punch blade 11BL, through the through-hole 11BR, a large quantity of fluid can be fed to the inside of the die hole 3H. Therefore, the discharge of the scrap S from the die hole 3H becomes even more reliable.

Figure 5:
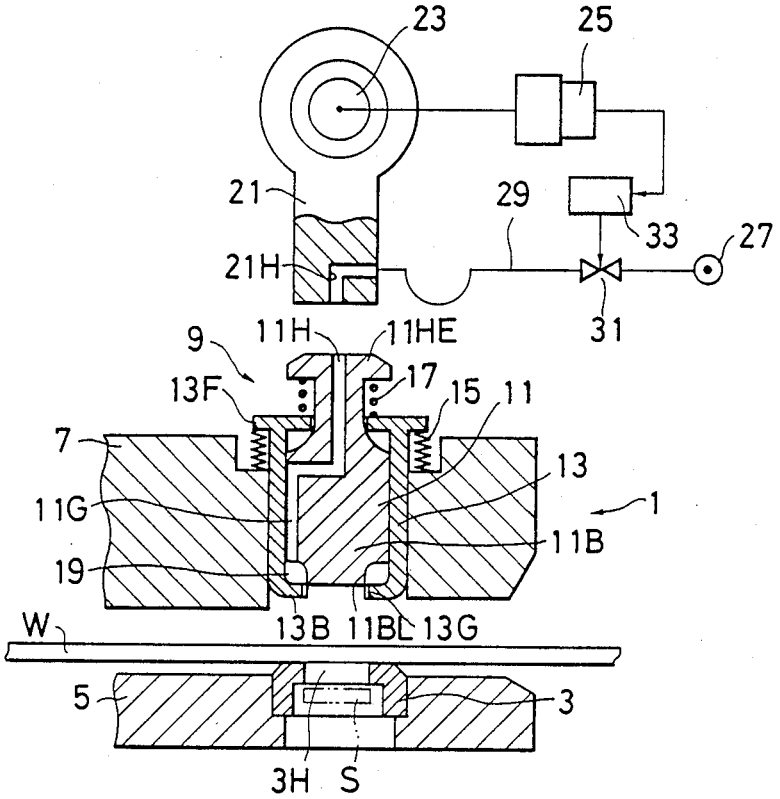
FIG. 5 is a schematic drawing showing an embodiment of the punch press of the present invention wherein a crank shaft is used to drive a ram.

FIG. 5 shows still another embodiment of the present invention. This shows in outline the case where the vertical movement of the ram 21 in the punch press is activated by means of a electric motor (not shown in FIG. 5) and eccentric shaft 23. It also shows in outline the control system which controls the shut-off valve 31 according to the vertical movement of the ram 21.

In FIG. 5 the structural parts which have the same functions as those in FIG. 1 bear the same symbols. The structure and the action of the punch set 9 mounted on the upper turret 7 and of the die 3 mounted on the lower turret 5 are almost the same as those explained in relation to FIG. 1, so further detailed explanation is omitted.

Detailed drawings have been omitted, however the eccentric shaft 23 is connected to or disconnected from a fly wheel which is turned by a motor through a clutch brake unit in the same way as a usual punch press. A rotation detection apparatus 25 such as, for example, a rotary encoder is connected to the eccentric shaft 23. Accordingly, the rotation of the eccentric shaft 23 is normally detected by the rotation detection apparatur 25 and the vertical position of the ram 21 is thus detected.

The shut-off valve control device 33 can be an NC control device on the turret punch press 1 or the like which calculates the vertical position of the ram 21 or the punch 11 based on the input signal from the rotation detection apparatus 25. When the ram 21 or the punch 11 descends to a previously set desired position, the shut-off valve control device 33 controls the shut-off valve 31 so that it is opened for a desired interval only. In addition, the timing of the opening and closing of the shut-off valve 31 under the control of the shut-off valve control device 33 is related to the vertical position of the ram 21 or the punch 11. Therefore, it can be optionally changed.

In addition, although not shown on the drawings, a positioning device is provided on the turret punch press 1 by which the workpiece W is clamped under the control of the NC control device and is positioned by being moved in the X-axis and Y-axis directions. Also, because this type of positioning device is commonly known, the explanation is omitted.

As a result of the above configuration, the ram 21 of the cylinder device 39 descends from the action of the motor (not shown in FIG. 5) and the crank shaft 23, and the lower edge of the ram 21 contacts the punch head 11HE of the punch 11. In addition, when the ram 21 is caused to descend, the punch 11 descends below its original position, and the lower edge of the punch 11 reaches a predetermined vertical position which is located slightly higher than the position of the upper surface of the workpiece W. Then the position detection device 41 detects the location, and a signal is sent from the shut-off valve control device 33 to the shut-off valve 31. The shut-off valve 31 is activated to open the connecting pipe 29, and the same action as previously described is performed.

Accordingly, the height of the punch 11 can be changed to correspond to any height and it is possible to cause the scrap securely to fall from the workpiece W.

It can readily be understood from the foregoing explanation of the embodiments that, by means of the present invention, the vertical position of the punch is detected relative to the ram or to the vertical action of the ram. When the ram or the punch descends to the desired position, the opening and closing of the shut-off valve is controlled and the fluid such as oil mist or the like is supplied to the end of the punch. The scrap in the die hole of the die is therefore securely caused to fall. Because of this configuration, even, the case where the height of the punch is varied can be easily handled and the scrap can be reliably caused to fall from the die hole.

In addition, even if string-shaped residue is adhering to the peripheral surface of the punch blade, that residue can be easily flushed from the periphery of the punch blade so that no damage is caused to the top surface of the workpiece W by the residue.

Also, the sliding parts of the punch set are automatically lubricated and this lubrication ensures that the life of the punch set is prolonged.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A punch press comprising:
a frame,
a die holder mounted on the frame,
a die having a diehole and mounted on the die holder;
a punch set having a punch guide, a punch holder and a punch wherein the punch guide is mounted in the punch holder in a vertically movable manner and the punch is mounted in the punch guide in a vertically movable manner, for performing a punching process on a workpiece in cooperation with the die,
the punch set being formed with a fluid discharge orifice means for discharging a fluid into the diehole and,
the punch being formed with a communication orifice communicating with the fluid discharge orifice, wherein the communication orifice communicates with an interstice between the punch guide and the punch holder;
a ram for striking the punch, formed with a fluid supply orifice for freely communicating with the communicating orifice; and
a connecting pipe means for connecting the fluid supply orifice with a fluid source.

2. The punch press of claim 1, wherein
the fluid discharge orifice is positioned on the periphery of the bottom edge of the punch.

3. The punch press of claim 1, wherein the fluid discharge orifice provided in the punch set is positioned at the center of the bottom surface of the punch.

4. The punch press of claim 1, further comprising:
a shut-off valve means for opening and shutting of the connecting pipe;
a stroke position detection means for detecting values of the stroke of the ram; and
a shut-off valve control means for controlling the opening and shutting of the shut-off valve means according to the values detected by the stroke position detection means.

5. A punch tool to be mounted on a punch press for punching a sheet-like workpiece in cooperation with a die being formed with a diehole, comprising:
a punch guide adapted to be mounted on a punch holder of the punch press in a vertically movable manner,
the punch guide being formed with through-hole means communicating with an interstice between the punch guide and the punch holder, and
a punch mounted in the punch guide in a vertically movable manner,
the punch being formed with a fluid discharge orifice means for discharging a fluid into the diehole, and a communication orifice means communicating with the through-hole.

6. A punch press comprising:
a frame,
a die holder mounted on the frame, a die formed with a diehole and mounted on the die holder;

a punch set provided with a punch mounted on a punch holder for performing a punching process on a workpiece in cooperation with the die, the punch set being formed with a fluid discharge orifice means for discharging a fluid into the diehole, and the punch being formed with a communication orifice communicating with the fluid discharge orifice;

a ram for striking the punch, formed with a fluid supply orifice for freely communicating with the communicating orifice;

a connecting pipe means for connecting the fluid supply orifice with a fluid source;

a shut-off valve means for opening and shutting of the connecting pipe;

a stroke position detection means for detecting values of the stroke of the ram; and a shut-off valve control means for controlling the opening and shutting of the shut-off valve means according to the values detected by the stroke position detection means.

7. The punch press of claim 6, wherein the fluid discharge orifice is positioned on the periphery of the bottom edge of the punch.

8. The punch press of claim 6, wherein the fluid discharge orifice provided in the punch set is positioned at the center of the bottom surface of the punch.

* * * * *